US005250119A

United States Patent [19]

Pöschl

[11] Patent Number: 5,250,119

[45] Date of Patent: Oct. 5, 1993

[54] PROCESS FOR CLEANING THE FILTERING MEDIUM OF A FILTERING CENTRIFUGE

[75] Inventor: Siegfried Pöschl, Penzberg, Fed. Rep. of Germany

[73] Assignee: Krauss Maffei, A.G., Fed. Rep. of Germany

[21] Appl. No.: 910,043

[22] Filed: Jul. 8, 1992

Related U.S. Application Data

[63] Continuation of Ser. No. 655,626, Feb. 15, 1991, abandoned.

[30] Foreign Application Priority Data

Feb. 15, 1990 [DE] Fed. Rep. of Germany ..... 4004763

[51] Int. Cl.[5] ..... B08B 3/06; B01D 24/44; B01D 29/70; B01D 33/15

[52] U.S. Cl. ..... 134/32; 134/34; 134/33; 134/22.1; 210/781; 210/791; 210/797; 210/798

[58] Field of Search ..... 134/33, 22.1, 32, 34; 210/781, 791, 797, 798

[56] References Cited

U.S. PATENT DOCUMENTS 4,146,476 3/1979 Spiewok ..... 210/781
4,552,669 11/1985 Sekellick ..... 210/798

*Primary Examiner*—Theodore Morris
*Assistant Examiner*—Zeinab El-Arini
*Attorney, Agent, or Firm*—Robert J. Koch

[57] ABSTRACT

A process is used to clean a filtering centrifuge. A base layer of filtered matter remains on the filtering medium of the centrifuge after the removal or repeated removal of a portion of a solid cake of filtered matter by a peeling blade and discharge apparatus. The process removes the base layer of solid filtered matter by initially penetrating and flooding the base layer with a liquid and then strongly braking or rapidly accelerating the drum of the filtering centrifuge to rapidly reduce or increase the rotational speed of the drum, respectively.

15 Claims, 1 Drawing Sheet

PROCESS FOR CLEANING THE FILTERING MEDIUM OF A FILTERING CENTRIFUGE

This is a continuation of application Ser. No. 07/655,626, filed Feb. 15, 1991, now abandoned.

BACKGROUND OF THE INVENTION

1. Field of the Invention

The invention relates to a process for cleaning the base layer of filtered matter from the filtering media in filter centrifuges which remains after peeling and discharge operations.

2. Description of the Related Art

It is known to blast off the base layer of filtered matter by exposure to a compressed gas. While the product residues on the surface of the filter medium are largely removed in this manner, product particles that have penetrated into the filter medium remain. In addition, the gaseous blasting medium must then be separated from the solids.

Given the fact that the lower areas of the filter are particularly wet in view of the prevailing capillary forces, there are strong adhesive and bonding effects present, which may interfere with blasting off the base layer.

It is further known to remove the base layer by a high pressure liquid spray. This, however, requires relatively large volumes of the liquid to achieve the desired effect. As a rule, however, large quantities of a liquid are undesirable, as they must again be separated from the solid material or even evaporated.

SUMMARY OF THE INVENTION

It is therefore an object of the invention to provide a process for an especially thorough cleaning of a filter medium in a filtering centrifuge by removing the remaining base layer of filtered matter, without additional equipment investments and with only small quantities of a liquid.

This object is attained by using the process of the present invention.

The invention relates to a filtering centrifuge having a rotating drum, a filtering medium and a peeling blade and discharge apparatus. During the centrifuging operation, a suspension flows into the drum and is separated into solid filtered matter and a filtrate. The solid filtered matter accumulates on the filtering medium, and the filtrate flows through the filtering medium and exits the rotating drum.

A cake of solid filtered matter accumulates on the filtering media of filter centrifuges during operation. The filter cake is removed in batches by a peeling and discharge apparatus. The filtering resistance of the filtering medium tends to increase as the base layer, which remains after peeling, becomes more dense after each peeling process It is therefore necessary to completely remove the base layer after a certain number of peeling and discharge processes from the filter medium.

The invention is based on the discovery that the adhesion of the solid components of the base layer among themselves and on the filter medium may be reduced by applying a liquid to achieve a saturating penetration and overflow of the base layer. If a strong braking force is applied to the drum, mass inertia shear forces are generated between the filter medium and the solid residues and the liquid to cause a largely complete separation of the base layer from the filtering medium.

Further objects, features and advantages of the present invention will become apparent from the detailed description of preferred embodiments which follows, when considered together with the attached figures of the drawing.

DESCRIPTION OF THE PREFERRED EMBODIMENT

Figure 1:
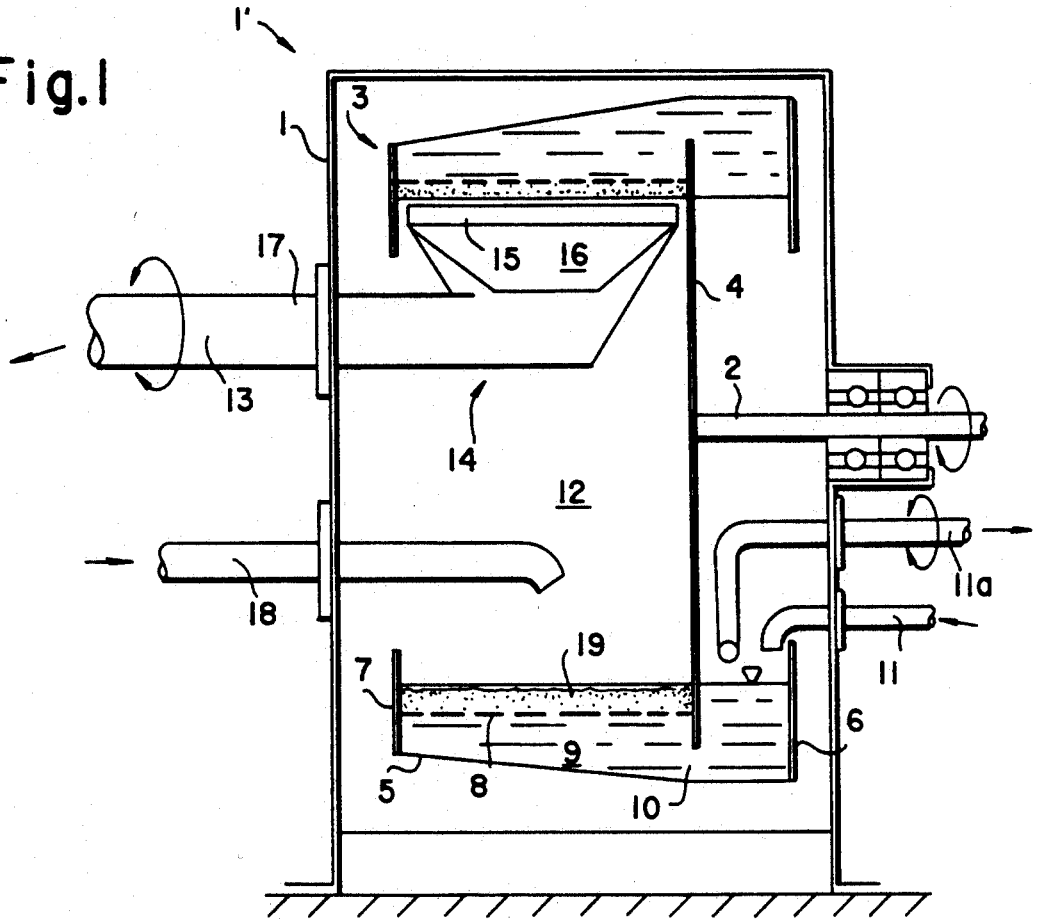
FIG. 1 shows a schematic view of a filtering centrifuge with a full jacket surrounding the filter medium and a bowl according to the preferred embodiment of the present invention.

FIG. 1 shows a filter centrifuge 1' configured with a siphon or reversible flow apparatus. A drum 3 having a horizontal rotating shaft 2 is disposed in a housing 1. The drum includes a drum bottom 4, a full jacket 5, a bowl 6, an annular rim 7 and a filtering medium 8. The full jacket 5 and filtering medium 8 define a filtrate collector space 9 which is in fluid communication with bowl 6 through passage opening 10 in drum bottom 4. A liquid feeder pipe 11 and a peeling tube 11*a* open into the bowl 6.

A discharge apparatus 14 pivots about a pivot axis 13 and carries a peeler blade 15 that extends over the axial length of the drum. Discharge apparatus 14 projects into the internal space 12 of drum 3. Peeler blade 15 is followed by a discharge funnel 16 which opens into a discharge pipe 17 equipped with a discharge screw (not shown). A suspension feeder pipe 18 further projects into inner space 12 of drum 3.

A base layer 19 of solid filtered material accumulates on filtering medium 8. The thickness of base layer 19 is determined by the radially outermost pivoting position of the peeler blade 15 during a peeling and discharge operation. In the position shown in the figures, the peeler blade is retracted from the surface of the base layer.

In operation, suspension feeder pipe 18 fills drum 3 with a suspension. During centrifuging, filtered matter is deposited on filtering medium 8 and a solid layer or cake of filtered matter accumulates thereupon. The filtrate flows through filtering medium 8, filter collector space 9 and passage opening 10 into bowl 6. The filtrate may be drawn off with peeler tube 11*a* that may be pivoted to the bottom of the bowl. The solid layer deposited on filtering medium 8 may be subsequently peeled off by pivoting peeler blade 15 into contact therewith and discharged through discharge funnel 16 and discharge pipe 17. Base layer 19 remains on filtering medium 8, which—especially following several peeling processes—becomes more dense, thereby increasing the filtering resistance of the filtering medium.

In the operating phase, in which base layer 19 is to be removed from filtering medium 8, liquid flows into bowl 6 through liquid feeder pipe 11 and passes through passage opening 10 into filtrate collector space 9, whereupon it flows through filtering medium 8 and the base layer radially from the outside of the drum to the inside, until the base layer is flooded. Preferably, a predetermined number of peeling and discharge operations are performed so the base layer remains capable of absorbing the liquid to saturation. However, it is not necessary to saturate the base layer to practice the invention. Further, it is not necessary to increase the mass or weight of the base layer with liquid. In practicing the invention, it is sufficient to make use only of the adhesion forces between the liquid layer and the surface of the base layer.

A braking force is applied to reduce the rotational speed and accompanying revolutions per minute (rpm) of the drum with a strong negative acceleration, so base layer 19, which is preferably saturated with the liquid, separates from filtering medium 8 and slides thereover. Preferably, the rotational speed of the drum is reduced and a number of peeling and discharge operations are carried out prior to the application of the braking force. The reduced rotational speed and executed peeling and discharge operations create the condition in which the base layer remains capable of absorbing the liquid until saturated, but no appreciable filtering of the liquid applied occurs. That condition minimizes the amount of liquid required to carry out the process. The intensity of the cleaning effect depends on the difference in rotational speed between the drum and the liquid loaded with the solids of the base layer. Recognizing that the cleaning effect depends on the difference in rotational speed between the drum and the liquid loaded with the solids of the base layer, the invention may also be practiced by applying a positive acceleration or accelerating force in lieu of the braking force previously described.

In this process, product residues settled under the filtering medium or on its support structure (not shown) may also be flushed away and drawn off together with the liquid from the bowl 6 by peeling tube 11*a*.

During the reverse flow filtering or the flooding of the base layer by the liquid, the rotational speed or rpm of the drum is determined by how strongly the residues of the base layer are adhering to the filter medium.

In stubborn cases, the process according to the invention may be repeated.

The rotational speed of the rotating drum will depend on the type of filtering process being performed. The range of rotational speeds (rpm) of the rotating drum when filtering the suspension depends on the diameter of the drum. Although any size drum may be used, it is preferable to use rotating drums having a drum diameter in the range from about 0.25 meters to about 2.50 meters. With respect to the drum diameter, it is contemplated to have rotational speeds sufficient to generate gravitational forces in the range from about 10 g to the limits of material stability of the drum (approximately 1000 g). During peeling, the rotational speed must not be in the range of critical rotational speed.

Preferably, the rotational speed just prior to applying the braking force is in the range from about 1/10 to ½ of the normal rotational speed. Of course, the gravitational force just prior to applying the braking force will depend on the kind of solid material being filtered. The braking force applied will also depend on the kind of solid material being filtered. Preferably, the liquid applied to the base layer is the liquid from the suspension. However, it is contemplated to use any liquid which has no solubility with respect to the solid particles of the base layer. An example of typical parameters of operation according to an embodiment of the invention includes:

| | |
|---|---|
| Diameter of a horizontal rotating drum | 1.60 meters |
| Rotational speed during filtering | 950 rpm |
| G-factor | 800 |
| Rotational speed just prior to applying the breaking force | 200 rpm |
| Rotational speed just after applying the braking force | 30 rmp |

The discharge of the liquid loaded with the solids of the separated base layer may be carried out at a reduced drum speed during which the solid-liquid mixture accumulates in the lower region and is suctioned off. Resumption of centrifuging accompanied by flow of suspension into the drum may also be effective. The flow of the suspension into the drum is resumed with the suspension flowing into the mixture that includes the solids of the separated base layer and the liquid. After the separated base layer is filtered, a normal operating cycle of the dewatering of a batch of the suspension results.

The discharge process is particularly simple in the case of centrifuges with a vertical rotating axle and bottom discharge. Following the braking of the drum, the mixture of solids of the separated base layer and the liquid slowly descends and drops from the drum.

Figure 2:
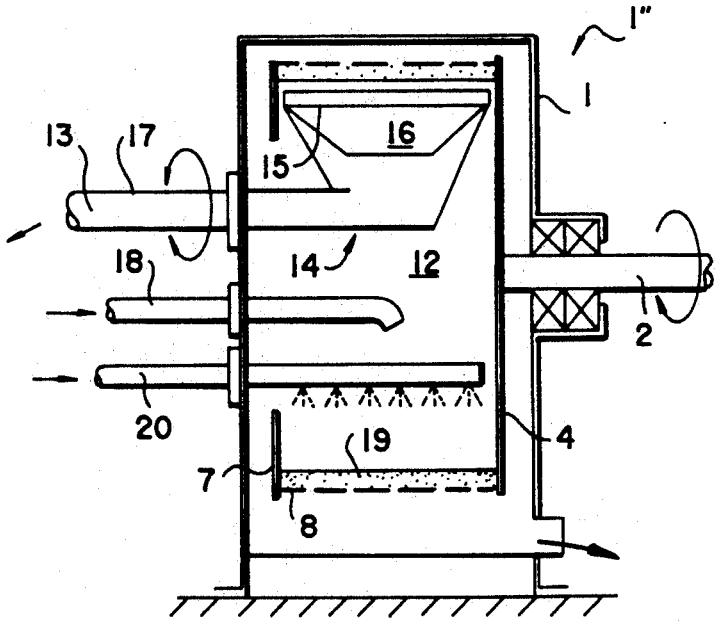
FIG. 2 shows a schematic view of another embodiment of a filtering centrifuge of the present invention having a more simple configuration.

FIG. 2 shows a filter centrifuge 1″ of simple configuration without a siphon or reverse filtering apparatus. The parts corresponding to those illustrated in FIG. 1 carry the same reference symbols. In a deviation from the embodiment of FIG. 1, a liquid feeder pipe 20 opens into inner space 12 of the drum and not into the bowl.

Base layer 19 is removed from filtering medium 8 in the following manner. Liquid is applied by liquid feeder pipe 20 from the inside of the drum to base layer 19. Preferably, the rotational speed or rpm of drum 3 is reduced and a predetermined number of peeling processes are carried out so the base layer remains capable of absorbing the liquid until saturation but no appreciable filtering of the liquid applied occurs prior to the application of the braking force. After saturating and flooding base layer 19 with the liquid, the process for the complete cleaning of the filtering medium as described above is effectuated.

The components of the separated base layer and liquid may be discharged in the same fashion as described above for the filter centrifuge with a siphon or reverse flow drum as shown in FIG. 1. The discharge of the mixture made up of the components of the separated base layer and the liquid may be carried out in a fashion similar to that of the first embodiment with a peeler tube (not shown) to suction off the mixture. The mixture may also be removed by initiating a new cycle of centrifuging with the introduction of a suspension into the drum containing the mixture for the subsequent normal operation of the dewatering of a batch of the suspension.

It is understood that the foregoing description is for illustrative purposes only. To those skilled in the art it will be apparent that the invention is capable of taking various useful forms and the scope of the invention is to be determined by the appended claims.

I claim:

1. A process for cleaning a filtering medium disposed about a rotating drum of a filtering centrifuge by removing a base layer of a solid cake of filtered matter, said process comprising the step of:

applying a force to the rotating drum to substantially change the rotational speed thereof so that the base layer separates from the filtering medium as a result of mass inertia shear forces.

2. A process according to claim 1, wherein the step of applying a force to the rotating drum further comprises:

applying a braking force to the rotating drum to reduce the rotational speed thereof.

3. A process according to claim 1, wherein the step of applying a force to the rotating drum further comprises:

applying an accelerating force to the rotating drum to increase the rotational speed thereof.

4. A process according to claim 1 further comprising the step:

exposing the base layer to a quantity of liquid sufficient to penetrate and overflow the base layer.

5. A process according to claim 4, further comprising the steps of:

applying the liquid to the base layer from the inside of the drum;

performing a predetermined number of peeling and discharge operations; and bringing the rotational speed of the drum to a level at which no appreciable filtering of the liquid applied takes place prior to the step of applying a force to the rotating drum.

6. A process according to claim 5 further comprising the steps of:

refilling the filtering centrifuge with a suspension after the step of applying a force to the rotating drum; and initiating a suspension dewatering cycle by centrifuging and a subsequent peeling and discharge operation on the solid cake.

7. A process according to claim 4, further comprising the steps of:

applying the liquid to the base layer from outside the drum;

performing a predetermined number of peeling and discharge operations; and bringing the rotational speed of the drum to a level at which no appreciable filtering of the liquid applied takes place prior to the step of applying a force to the rotating drum.

8. A process according to claim 7 further comprising the steps of:

refilling the filtering centrifuge with a suspension after the step of applying a force to the rotating drum; and initiating a suspension dewatering cycle by centrifuging and a subsequent peeling and discharge operation on the solid cake.

9. A process according to claim 4, wherein the step of exposing the base layer to the liquid comprises the liquid flowing through a bowl, a filtrate collector space surrounded by the filtering medium and a full jacket and overflowing the base layer.

10. A process according to claim 9 further comprising the steps of:

refilling the filtering centrifuge with a suspension after the step of applying a force to the rotating drum; and initiating a suspension dewatering cycle by centrifuging and a subsequent peeling and discharge operation on the solid cake.

11. A process according to claim 4 further comprising the steps of:

refilling the filtering centrifuge with a suspension after the step of applying a force to the rotating drum; and initiating a suspension dewatering cycle by centrifuging and a subsequent peeling and discharge operation on the solid cake.

12. A process for cleaning a filtering medium disposed about a rotating drum of a filtering centrifuge by removing a base layer of solid matter, said process comprising the step of:

applying to force to the rotating drum to substantially change the rotational speed thereof so that the base layer separates from the filtering medium as a result of mass inertia shear forces.

13. A process according to claim 12 further comprising the step:

exposing the base layer to a quantity of liquid sufficient to penetrate and overflow the base layer.

14. A process according to claim 13, wherein the step of applying a force to the rotating drum further comprises:

applying a braking force to the rotating drum to reduce the rotational speed thereof.

15. A process according to claim 13, wherein the step of applying a force to the rotating drum further comprises:

applying an accelerating force to the rotating drum to increase the rotational speed thereof.

* * * * *